United States Patent [19]

Anthony et al.

[11] 4,184,234

[45] Jan. 22, 1980

[54] ANTI-CREEP SEAT BELT BUCKLE AND TONGUE COMBINATION

[75] Inventors: James R. Anthony; Allan R. Lortz, both of Indianapolis, Ind.

[73] Assignee: Indiana Mills & Manufacturing Inc., Carmel, Ind.

[21] Appl. No.: 942,938

[22] Filed: Sep. 18, 1978

[51] Int. Cl.[2] ..... A44B 11/06; A44B 11/10

[52] U.S. Cl. ..... 24/196; 24/171

[58] Field of Search ..... 24/196, 171

[56] References Cited

U.S. PATENT DOCUMENTS

| | | | |
|---|---|---|---|
| 3,121,272 | 2/1964 | Matthews | 24/196 |
| 3,293,713 | 12/1966 | Gaylord | 24/196 |
| 3,414,947 | 12/1968 | Holmberg | 24/196 |
| 3,591,900 | 7/1971 | Brown | 24/196 |
| 3,898,715 | 8/1975 | Balder | 24/196 |

FOREIGN PATENT DOCUMENTS

| | | | |
|---|---|---|---|
| 2046077 | 3/1972 | Fed. Rep. of Germany | 24/196 |

*Primary Examiner*—Bernard A. Gelak

*Attorney, Agent, or Firm*—Woodard, Weikart, Emhardt & Naughton

[57] ABSTRACT

A seat belt buckle and tongue combination with means limiting relative motion between the combination frame and the belt or web attached thereto. A roller bar is slidably mounted to the combination frame with the opposite ends of the bar extending into slots on the frame. A pair of helical springs are positioned in the slots to urge the roller bar toward a stop edge on the frame to secure the web against the stop edge and limit relative motion between the web and the roller bar. A pair of clips secure the springs within the slots.

7 Claims, 12 Drawing Figures

ANTI-CREEP SEAT BELT BUCKLE AND TONGUE COMBINATION

BACKGROUND OF THE INVENTION

This invention is in the field of seat belt buckles and other devices for restraining movement of a person. Seat belt buckles and their associated tongues are secured conventionally to belts fixedly mounted to the vehicle. Generally, a knurled bar is provided on the seat belt tongue and/or the seat belt buckle with the seat belt extending partially around the associated knurled bar. In order to tighten the seat belt buckle and tongue combination, the free end of the belt is pulled around the bar until the belt is tight. Over a period of time, the belt may slip relative to the knurled bar until the belt is loose. As a result, the person must then once again tighten the belt. This problem is particularly present and critical in heavy earth-moving vehicles which encounter rough terrain thereby applying a jerking motion to the occupant and seat belt buckle tongue combination. Disclosed herein is an anti-creep device for applying force to limit relative motion between the seat belt buckle-tongue combination and the seat belt web or belt.

SUMMARY OF THE INVENTION

One embodiment of the present invention is a device for restraining movement of a person with the device including a frame and a roller bar movably mounted on the frame, a web extending around the bar, the web having a first end portion to anchor the web, wherein the improvement comprises the frame including stop means contactable against the web operable to limit movement of the web relative to the bar, biasing means mounted on the frame and operably engaged with the bar being operable to normally urge the bar toward the stop means and the web against the stop means but being yieldable upon application of a certain force to allow movement of the bar from the stop means and movement of the web relative to said bar.

Another embodiment of the present invention is a seat belt buckle-tongue combination comprising a frame with a pair of slots having a roller bar with opposite ends slidably mounted in the slots, the frame having a web stop extending parallel to the bar, a web extending at least partially around the bar and biasing means mounted on the frame operable to position and releasably hold the web against the web stop limiting relative motion between the bar and web.

It is an object of the present invention to provide an anti-creep device in a seat belt buckle-tongue combination to limit relative motion between the combination and the seat belt.

A further object of the present invention is to provide an improved device for restraining movement of a person on a vehicle.

Related objects and advantages of the present invention will be apparent from the following description.

DESCRIPTION OF THE PREFERRED EMBODIMENT

Figure 1:
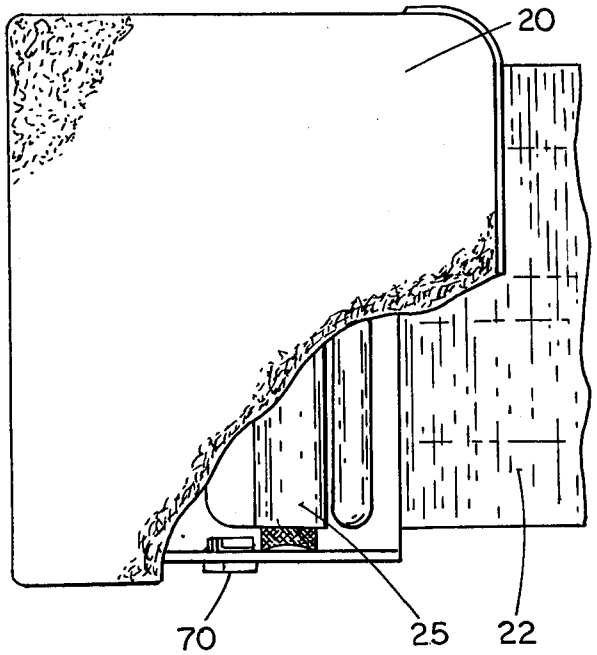
FIG. 1 is a fragmentary top view of a seat belt buckle incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
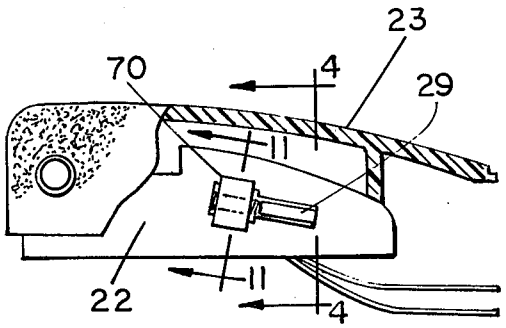
FIG. 3 is a side fragmentary view of the buckle of FIG. 1.
Figure 2:
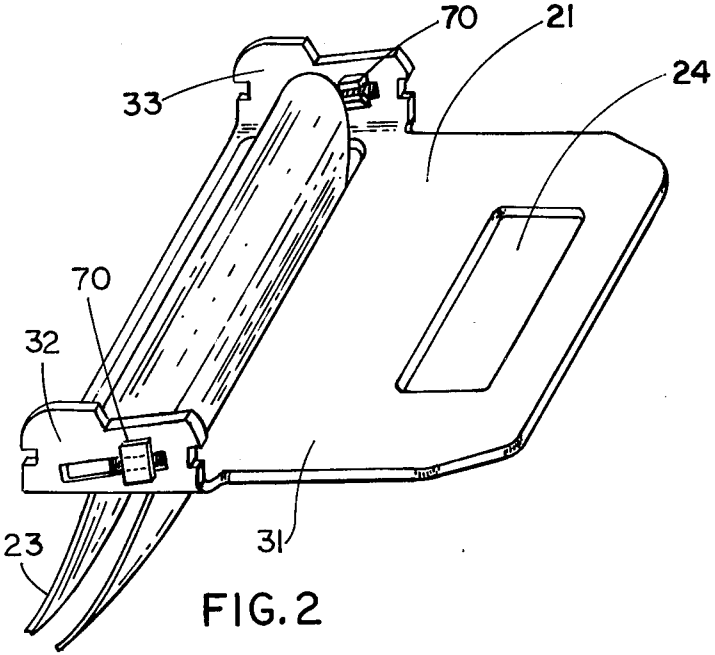
FIG. 2 is a perspective view of a seat belt tongue incorporating the present invention.

Referring now more particularly to the drawings and in particular to FIGS. 1 and 2, there is shown a seat belt buckle 20 with associated seat belt tongue 21 respectively attached to webs or belts 22 and 23. The preferred embodiment of the anti-creep device disclosed herein may be used with any number of different types of conventional buckles and tongues. In the buckle shown in FIGS. 1 and 3, the buckle is provided with a main frame 22 having a pivotable buckle cover mounted thereto which is operable when pivoted to release a spring-loaded latch bar mounted atop frame 22 with the latch bar being engageable with the aperture 24 of the plate-like main body of tongue 21 (FIG. 2). Buckle 20 is provided with a conventional knurled roller bar 25 having a pair of opposite ends slidably received in slots provided on the upstanding arms of frame 22. Main frame 22 includes a bottom wall 26 (FIG. 4) integrally joined to a pair of upstanding arms 27 and 28 having cover 23 pivotally mounted thereto. In a conventional buckle, the roller bar 25 has a pair of opposite ends 29 and 30 respectively mounted in slots in arms 27 and 28. Opposite ends 29 and 30 of roller bar 25 are typically elongated having a plate configuration as shown in FIG. 3 so as to prevent the roller bar from rotating but allowing the bar to slide the length of the slot.

Referring to FIG. 2, seat belt tongue 21 also has a bottom wall 31 with a pair of upstanding arms 32 and 33 each provided with a slot to receive the opposite ends of the roller bar. Seat belt 23 extends around the roller bar mounted to tongue 21 in a manner identical to that described for buckle 20.

Figure 4:
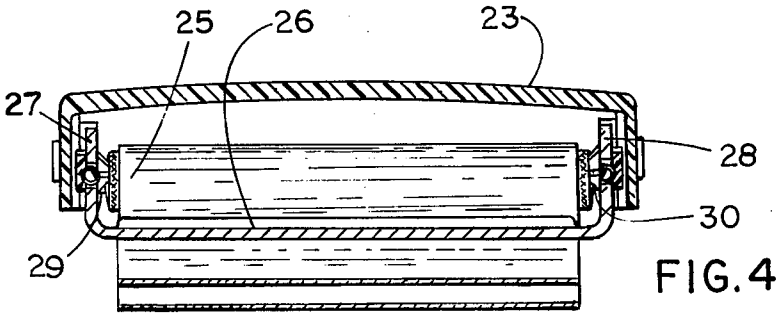
FIG. 4 is a cross-sectional view taken alone line 4—4 of FIG. 3 and viewed in the direction of the arrows.
Figure 9:
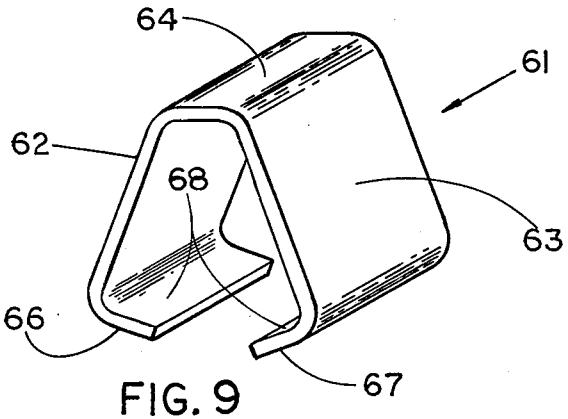
FIG. 9 is a perspective view of a third embodiment of the anti-creep spring clip.
Figure 10:
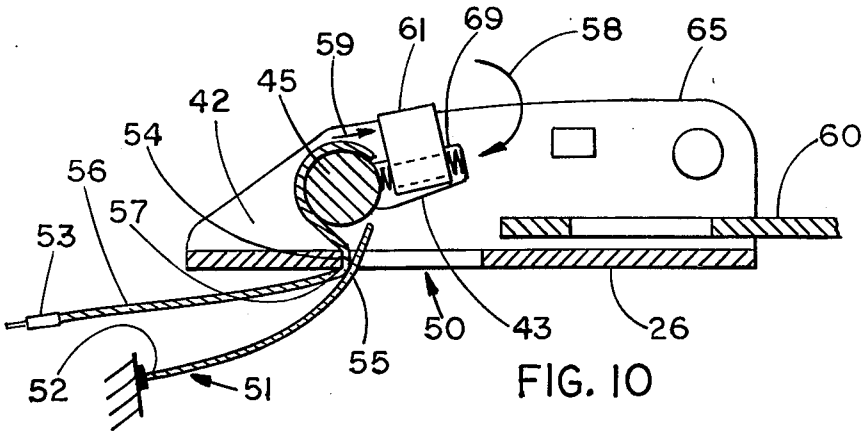
FIG. 10 is a reduced fragmentary cross-sectional view taken along line 10—10 in FIG. 8 and viewed in the direction of the arrows.
Figure 5:
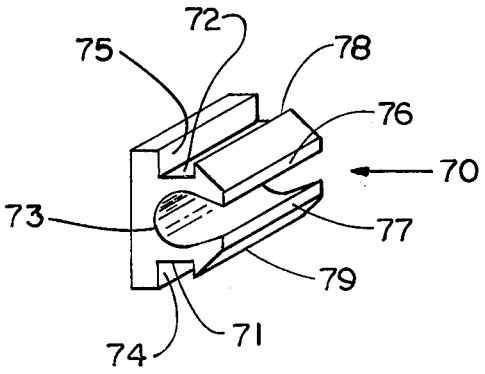
FIG. 5 is an enlarged perspective view of the anti-creep clip shown mounted to the buckle of FIG. 3.
Figure 6:
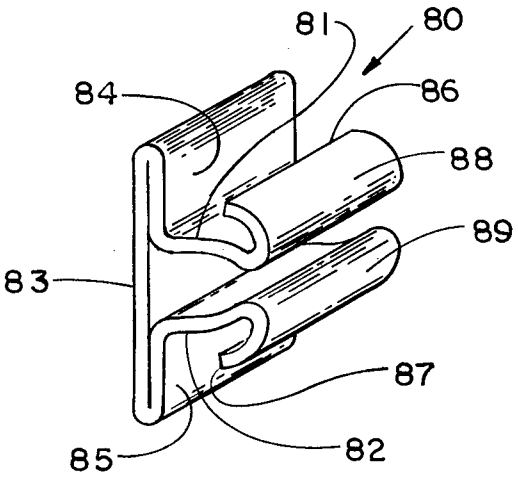
FIG. 6 is the same view as FIG. 5 only showing an alternate embodiment of the anti-creep spring clip.
Figure 7:
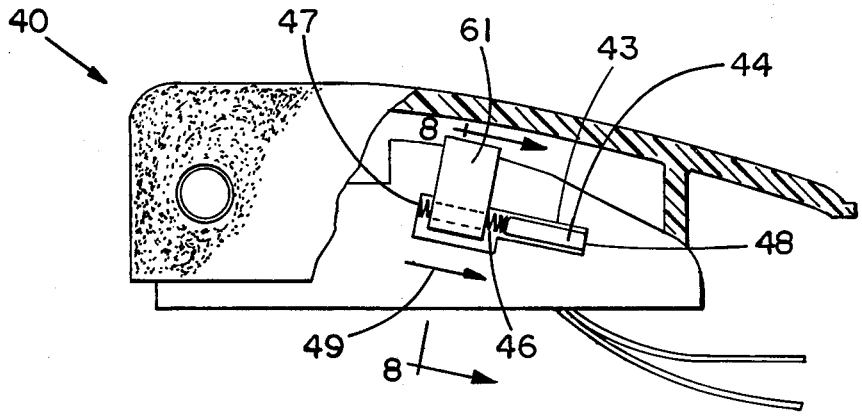
FIG. 7 is the same view as FIG. 3 only enlarged and showing yet another embodiment of the anti-creep spring clip mounted to the buckle.
Figure 8:
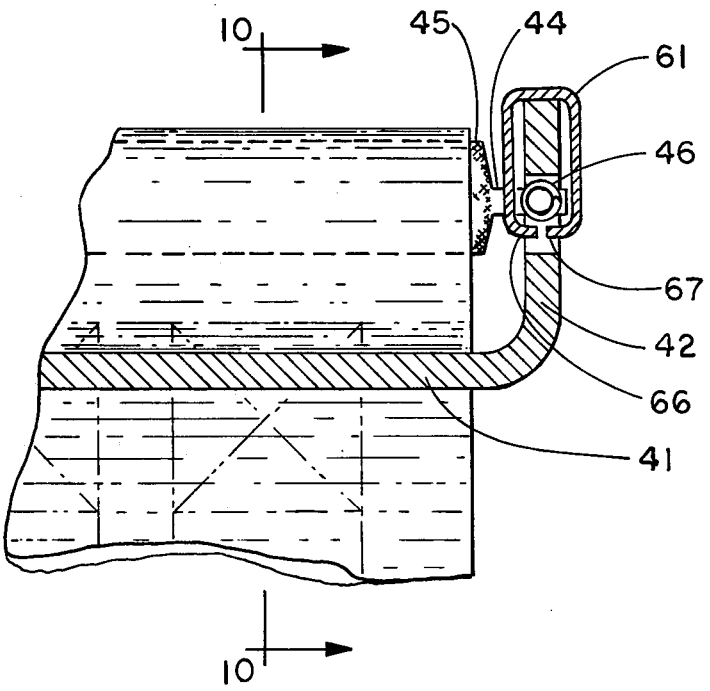
FIG. 8 is an enlarged fragmentary cross-sectional view taken along line 8—8 of FIG. 7 and viewed in the direction of the arrows.

In the preferred embodiment of the present invention, buckle 20 and seat belt tongue 21 are provided with a biasing means which includes a helical spring for urging the seat belt roller bar toward the bottom wall of each frame so as to force the seat belt or web against the bottom wall and thereby limit relative motion between the seat belt and roller bar. The helical spring is retained in the frame by a clip, three embodiments of which are shown in FIGS. 5, 6 and 9. FIGS. 1-4 depict the helical spring as being retained by the clip shown in FIG. 5 whereas FIGS. 7, 8 and 10 depict the clip shown in FIG. 9 mounted to the buckle. The buckle shown in FIGS. 7, 8 and 10 is identical with the buckle shown in FIGS. 1, 3 and 4 with the exception of the particular clip used to retain the helical spring.

The biasing action of the spring in combination with the roller bar and seat belt will now be described for the buckle shown in FIGS. 7, 8 and 10, it being understood that an identical description applies for the buckle shown in FIGS. 1, 3 and 4 and the seat belt tongue shown in FIG. 2 and provided with clips 70 or 80. Buckle 40 (FIG. 7) is provided with a pair of upstanding arms integrally connected to a bottom wall, such as previously described for buckle 20. For example, bottom wall 41 has an upstanding arm 42 (FIG. 8) which in turn includes slot 43 receiving one end 44 of roller bar 45. A helical spring 46 having a diameter not exceeding the thickness of wall 42 is provided in slot 43 having a first end in contact with the elongated end 44 of the roller bar and with the spring having an opposite end in contact with the slot end 47. Normally, helical spring 46 urges roller bar 44 in the direction of arrow 49 so that the roller bar end contacts slot end 48.

As shown in FIG. 10, bottom wall 26 is provided with a seat belt slot 50 which extends between the opposite upstanding arms of the buckle frame and at least through a distance equal to the width of the seat belt. Seat belt 51 has a botttom end 52 fixedly attached to a permanent structure such as the vehicle frame. The seat belt then extends through slot 50 and around roller bar 45 and then back through slot 50 where the free end 53 of the seat belt may be grasped by the person in order to tighten or loosen the belt and buckle combination. The rear edge 54 of wall 26 forming slot 50 provides a stop means against which the seat belt is forced so as to prevent the belt from slipping around roller bar 45. In conventional buckles, roller bar 45 will move within slot 43 whenever the vehicle encounters rough terrain which applies in cyclic fashion force to the end 52 of the belt. As the roller bar oscillates in slot 43, relative motion will occur between the bottom portion 57 of edge 54 and the top layer 56 of the seat belt thereby eventually causing the belt to creep or move around roller bar 45 loosening the belt with respect to the buckle. This particular problem is solved by the addition of the biasing means which includes the helical spring which is operable to normally urge the bar toward the stop means or edge 54 and the belt against edge 54. On the other hand, the helical spring is yieldable when the person desires to loosen the belt by pivoting the buckle 58 in a clockwise direction as shown by arrow 58 thereby moving the belt away from edge 54 so as to move the belt around roller bar 45 and to allow movement of the roller bar slightly away from the edge 54 in a direction shown by arrow 59.

Slot 43 is shown as slightly enlarged to receive the helical spring as compared to the portion of the slot receiving the end of the roller bar; however, it is to be understood that the slot may have a uniform width assuming the helical spring is approximately the same size in diameter as the height of the end of the roller bar. Likewise, while although only one arm 42 of the seat belt buckle frame has been shown and described as including a slot with a helical spring, it is to be understood that an identical slot, spring and clip is provided on the other upstanding arm of the buckle frame. In addition, only a portion of the seat belt tongue 60 is shown in FIG. 10 as being inserted into the buckle, it being understood that the seat belt tongue 60 may be provided with a pair of upstanding arms provided with slots, helical springs and clips for receiving the opposite ends of a roller bar such as shown for tongue 21 in FIG. 2.

Clip 61 (FIG. 9) secures the helical spring within the slot of the buckle shown in FIG. 10. Clip 61 has a pair of spaced apart legs 62 and 63 with proximal end portions integrally joined together at the top end 64 of the clip. End 64 of clip 61 is positioned atop and extends over the upper edge 65 (FIG. 10) of wall 42 with legs 62 and 63 then extending downwardly against the opposite sides of wall 42. Prior to installation of the clip 61, ends 66 and 67 are spaced apart and upon installation are forced manually together as shown in FIG. 8. The bottom ends 66 and 67 of clip 61 are mutually opposed and extend inwardly into slot 43 so as to retain the helical spring within the slot between the upper surfaces 68 of ends 66 and 67 (FIG. 9) and the top edge 69 (FIG. 10) of the slot. Thus, at least a portion of legs 62 and 63 extends through the slot and wall 42 with the helical spring being located between legs 62 and 63.

Alternate embodiments of clip 61 are shown in FIGS. 5 and 6. Clip 70 (FIG. 5) includes a pair of spaced apart legs 71 and 72 with the legs including proximal end portions integrally joined together at end 73 of the clip. A pair of shoulders 74 and 75 are provided at end 73 being located outwardly of the legs so as to abut against the outwardly facing surface of wall 22 (FIG. 3). Likewise, clip 80 (FIG. 6) is provided with a pair of legs 81 and 82 integrally joined together by wall 83 forming a pair of shoulders 84 and 85 outwardly of the legs to abut against the outside surface of the buckle frame upstanding arm 22. Clips 70 and 80 are configured similarly with clip 80 being formed from sheet material such as metal whereas clip 70 may be molded from a plastic material. The spaced apart legs of clips 70 and 80 are both provided with projections for contacting the inwardly facing surface of the buckle frame upstanding wall 22. For example, clip 70 includes projections 78 and 79 respectively formed on legs 72 and 71 between shoulders 75 and 74 and the extreme distal ends 76 and 77. Thus, a slot is formed between shoulder 75 and projection 78 and between shoulder 74 and projection 79 with the frame wall such as wall 22 projecting into the slots thereby allowing for the mounting of clip 70 to the wall. Legs 71 and 72 are semi-flexible to allow the insertion of the clip into the slot formed in wall 22. Legs 71 and 72 are located the farthest from shoulder 75 and 74 at the distal end 76 and 77 of the legs. This is not true for clip 80 which has distal ends 86 and 87 located closer to shoulders 84 and 85 than the extreme portions 88 and 89 of the legs. Legs 81 and 82 extend through the rounded extreme portions 88 and 89 and then turn backward toward shoulders 84 and 85. Thus, a slot is formed between shoulder 84 and end 86 and between shoulder 85 and end 87 into which the buckle frame upstanding arm such as arm 22 projects retaining the clip within the slot housing the helical spring. Legs 81 and 82 extend in a direction away from the shoulders and then in a direction toward the shoulders with the distal ends 86 and 87 being located nearer the shoulders than certain portions of the legs. While the buckle shown in FIG. 3 is depicted as having clip 70 retaining the helical spring within the slots, it is to be understood that clip 70 may be replaced by clip 80 or by clip 61.

Figure 11:
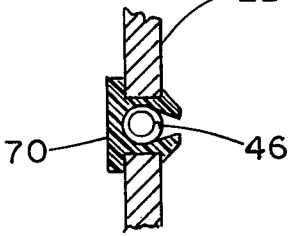
FIG. 11 is an enlarged fragmentary cross-sectional view taken along line 11—11 of FIG. 3 and viewed in the direction of the arrows.

Legs 81 and 82 of clip 80 are also sufficiently flexible so as to allow the legs to move together when the clip is initially positioned into the slot of wall 22. In order to install the helical spring along with clips 70, 80 or 90 (FIG. 11), the helical spring may initially be inserted into the clip between the clip legs with the clip legs then being inserted into the slot formed in wall 22 in such a manner that the opposite ends of the helical spring are positioned between end 29 of the roller bar and the slot end as shown in FIG. 3.

Figure 12:
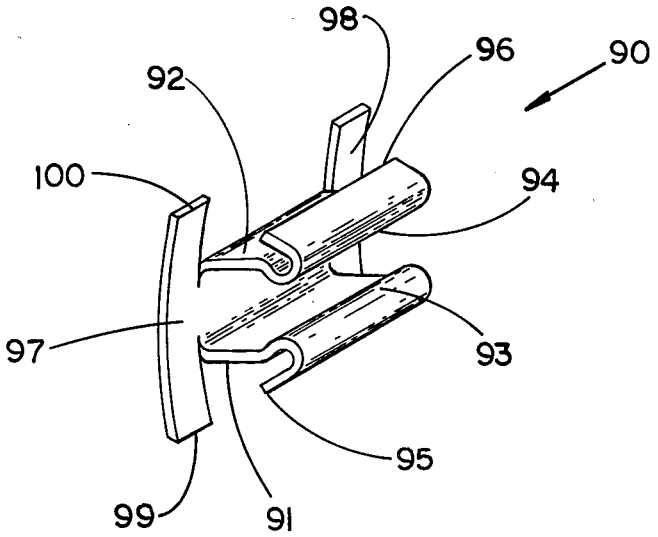
FIG. 12 is the same view as FIG. 5 only showing yet another embodiment of the anti-creep spring clip.

Yet another embodiment of the clip is shown in FIG. 12. Clip 90 includes a main body having a pair of spaced apart legs 91 and 92 which are initially parallel as the legs extend outwardly from their point of attachment at base arms 97 and 98. Legs 91 and 92 extend through a slightly converging manner at portions 93 and 94 in order to retain the helical spring and then diverge to distal ends 95 and 96. Base arms 97 and 98 are concave in configuration as viewed from the distal ends 95 and 96 of legs 91 and 92 with the base arms produced from a relatively thin plastic or metal material thereby providing spring action between base arms 97 and 98 and the distal ends 95 and 96 of the legs. For example, the bottom and top ends 99 and 100 of base arm 97 are located closer to distal ends 95 and 96 as compared to the central portion of base arm 97. As previously described for the other clips, the helical spring is positioned between legs 91 and 92 with wall 22 being located in the channel formed between the top ends of base arms 97 and 98 and distal end 96 of leg 92. Likewise, wall 22 extends between distal end 95 of leg 91 and the bottom ends of base arms 97 and 98 in a manner similar to that shown for clip 70 in FIG. 11. While clips 70, 80 and 90 have been described with respect to the buckle of FIG. 3, it is to be understood that an identical description applies to the clip retaining the helical springs in walls 32 and 33 of seat belt tongue 21 shown in FIG. 2.

Many variations are contemplated and included in the present invention. For example, the biasing means shown in the drawings is depicted in combination with a seat belt buckle and a seat belt tongue; however, it is to be understood that such a combination may be used on any type of device for restraining movement of a person, such as a shoulder harness type of restraining device. Likewise, a variety of different types of clips and retaining devices may be used to secure the helical spring within the slot. Likewise, a variety of different types of biasing means other than helical springs may be used to urge the belt roller bar toward the back end of the buckle or tongue so as to maintain contact between the stop edge provided on the back portion of the slot of the buckle or frame through which the seat belt projects and is retained. As shown in FIGS. 8 and 10, the roller bar 45 extends parallel to the stop edge 54 so as to maintain uniform resistance between edge 54 and the top layer 56 of the belt.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. In a device for restraining movement of a person with said device including a frame and a roller bar movably mounted on said frame, a web extending around said bar, said web having a first end portion to anchor said web, wherein the improvement comprises:

said frame including stop means contactable against said web operable to limit movement of said web relative to said bar;

biasing means mounted on said frame and operably engaged with said bar being operable to normally urge said bar toward said stop means and said web against said stop means but being yieldable upon application of a certain force to allow movement of said bar from said stop means and movement of said web relative to said bar, said frame includes a wall with a slot extending through said wall in which said bar is slidably mounted, said biasing means includes a spring urging said bar toward one end of said slot, said spring is located in said slot, said biasing means includes retaining means securing said spring in said slot; and said retaining means includes a clip with a pair of spaced apart legs, said legs include proximal ends attached together, said legs extend through said slot and wall with said spring located and retained between said legs.

2. The device of claim 1 wherein said clip has a pair of shoulders located outwardly of said legs at said proximal ends, said legs include projections formed thereon, said legs extend through said wall with said shoulders and projections located outwardly of said wall limiting movement of said clip relative to said wall.

3. The device of claim 2 wherein said legs have distal ends, said legs have portions located farthest from said shoulders at said distal ends.

4. The device of claim 2 wherein said legs have distal ends, said legs extend in a direction away from said shoulders and then in a direction toward said shoulders with said distal ends located nearer said shoulders than certain portions of said legs.

5. The device of claim 1 wherein said clip extends externally of and atop said wall and then downwardly adjacent opposite sides of said wall, said clip includes mutually opposed distal end portions which extend inwardly into said slot retaining said spring in said slot between said distal end portions and said wall.

6. A seat belt device comprising:

a frame with a pair of slots having a roller bar with opposite ends slidably mounted in said slots, said frame also having a web stop extending parallel to said bar;

a web extending at least partially around said bar; and biasing means mounted on said frame operable to position and releasably hold said web against said web stop limiting relative motion between said bar and web;

retaining means mounted on said frame adjacent said biasing means and being operable to retain said biasing means on said frame;

said biasing means includes a pair of helical springs positioned in said slots and said retaining means includes a pair of clips projecting into said slots securing said springs therein.

7. A seat belt device comprising:

a frame with a pair of slots having a roller bar with opposite ends slidably mounted in said slots, said frame also having a web stop extending parallel to said bar;

a web extending at least partially around said bar; and biasing means mounted on said frame operable to position and releasably hold said web against said web stop limiting relative motion between said bar and web;

retaining means removably positioned adjacent said biasing means and being operable to retain said biasing means on said frame;

said biasing means includes a pair of separate springs positioned in said slots and said retaining means includes a pair of clips securing said springs therein.

* * * * *